US008936015B2

(12) United States Patent
Ling

(10) Patent No.: US 8,936,015 B2
(45) Date of Patent: Jan. 20, 2015

(54) REPEATING MECHANISM FOR AIR GUN

(76) Inventor: Jiahong Ling, Zhejiang (CN)

( * ) Notice: Subject to any disclaimer, the term of this patent is extended or adjusted under 35 U.S.C. 154(b) by 354 days.

(21) Appl. No.: 13/258,699

(22) PCT Filed: Mar. 8, 2010

(86) PCT No.: PCT/CN2010/070907

§ 371 (c)(1),
(2), (4) Date: Sep. 22, 2011

(87) PCT Pub. No.: WO2011/006371

PCT Pub. Date: Jan. 20, 2011

(65) Prior Publication Data

US 2012/0097143 A1 Apr. 26, 2012

(30) Foreign Application Priority Data

Jul. 13, 2009 (CN) ..... 2009 1 0100618

(51) Int. Cl.
*F41B 11/00* (2013.01)
*F41B 11/721* (2013.01)

(52) U.S. Cl.
CPC ..... *F41B 11/721* (2013.01)
USPC ..... 124/31

(58) Field of Classification Search
USPC ..... 124/31, 55–57, 60, 63–77
See application file for complete search history.

(56) References Cited

U.S. PATENT DOCUMENTS

2006/0107938 A1 5/2006 Rice ..... 124/73
2007/0215133 A1 9/2007 Jones ..... 124/73
2008/0290132 A1* 11/2008 Liang ..... 227/130

OTHER PUBLICATIONS

Chinese Utility Model Publication No. CN 2110844 U, Jul. 22, 1992, 6 pages.

* cited by examiner

*Primary Examiner* — Gene Kim
*Assistant Examiner* — Amir Klayman
(74) *Attorney, Agent, or Firm* — Alan D. Kamrath; Kamrath IP Lawfirm, P.A.

(57) ABSTRACT

A repeating mechanism for an air gun includes a high pressure air storage chamber and a driving air chamber. An air stream automatic control valve is arranged between the high pressure air storage chamber and the driving air chamber. An air outlet valve is arranged between the driving air chamber and an air outlet and interlocked with a trigger interlock mechanism. The repeating mechanism can achieve the purpose that corresponding high pressure air can be blown inside according to the designed pressure force of the high pressure air storage chamber and the driving air chamber, and the process of opening or closing the air outlet valve of the air gun can not be limited by the pressure force of the high pressure air, thereby obtaining the air gun with a further firing range or obtaining more firing frequency after aeration.

16 Claims, 5 Drawing Sheets

REPEATING MECHANISM FOR AIR GUN

BACKGROUND OF THE INVENTION

1. Field of the Invention

The present invention relates to a pre-charged air gun structure element and, more specifically, a repeating mechanism for an air gun.

2. Description of the Related Art

Current pre-charged air guns always have hammers, which strike the air outlet valve to directly release the air from the high pressure air storage chamber to drive a projectile out. When the air pressure in the high pressure air storage chamber decreases, the initial projectile velocity reduces, and so does the shooting range. If it is intended to keep the initial projectile velocity consistent, a constant pressure device is then required, which would complicate the structure of the air gun. In addition, for current pre-charged air guns, if the air pressure in the high pressure air storage chamber is too high, it will cause difficulties to open or close the air outlet valve, and thus affect the effective shooting.

SUMMARY OF THE INVENTION

It is thus an object of the present invention to provide a repeating mechanism for an air gun with a continuous shooting ability and with nearly identical initial velocities of shots under effective air pressure.

This object is achieved according to the invention by the feature of a repeating mechanism for an air gun comprising a high pressure air storage chamber and a driving air chamber. An air stream automatic control valve is arranged between the high pressure air storage chamber and the driving air chamber. An air outlet valve is arranged between the driving air chamber and the air outlet. The air outlet valve is interlocked with a trigger interlock mechanism. The air outlet valve is interlocked with the trigger interlock mechanism, and the air outlet valve is connected with a piston, whose one end is located inside the driving air chamber and the other end reaches out of the driving air chamber via a piston sealing ring and is then interlocked with the trigger interlock mechanism. The diameter of the piston can be greater than that of the air outlet valve gate. The piston can be arranged with a piston return spring. An bypass air stream hole is arranged between the high pressure air storage chamber and the driving air chamber. The air stream automatic control valve is normally open in a static state, which means that an air stream automatic control valve return spring arranged on the air stream automatic control valve gate pushes or pulls the air stream automatic control valve gate open in a static state to enable it to be in a normally open state. In order to ensure that when every time the driving air chamber releases the air, the automatic projectile feeder is able to continuously supply projectiles. Accordingly, an automatic projectile feeder can be linked with an air passage of either the high pressure air storage chamber or the driving air chamber or both and controlled by the air pressure of that chamber to achieve synchronization between the continuous projectile feeding action and the air release time of the driving air chamber.

When an air gun works, assume that the air pressure of the high pressure air storage chamber is P1 and the air pressure of the driving air chamber is P2. Since the air stream automatic control valve is normally open in a static state, then P1=P2. When the trigger interlock mechanism is triggered, the piston will be released and pushed backwards under the effect of P2. The air outlet valve is opened to release the driving air from the driving air chamber. With the decline of P2, when the force of the P1 on the air stream automatic control valve is greater than the force of the P2+ air stream automatic control valve return spring, the air stream automatic control valve will be automatically closed, the pressure of P2 will instantaneously reduce, and the piston, under the force of the piston return spring, will drive the air outlet valve to close. The pressure of P2 will rise under the effect of the bypass air stream hole and the air stream automatic control valve will reopen to achieve a new balance under the effect of the air stream automatic control valve return spring. As long as the trigger interlock mechanism is continuously pulled, the air outlet valve and the air stream automatic control valve will open or close repeatedly, so that continuous shooting is achieved.

A repeating mechanism for an air gun according to the invention can achieve the purpose that corresponding high pressure air can be blown inside according to the designed pressure force of the high pressure air storage chamber and the driving air chamber, and the process of opening or closing the air outlet valve of the air gun cannot be limited by the pressure force of the high pressure air, thereby obtaining the air gun with a further firing range or obtaining more firing frequency after aeration. The structure provided by the invention can control the air pressure dropping time of the driving air chamber by adjusting the opening degree of the air stream automatic control valve at any time to further control the flow rate of air emission. In addition, the present invention can guarantee to the utmost extent that the initial velocities of shots of different weights of the air gun are nearly identical with one another and increase the use ratio of air to the utmost extent. In particular, the repeating mechanism used in the invention can be applied to design an automatic fire air gun without a driving hammer.

DETAILED DESCRIPTION OF THE PREFERRED EMBODIMENT

Figure 1:
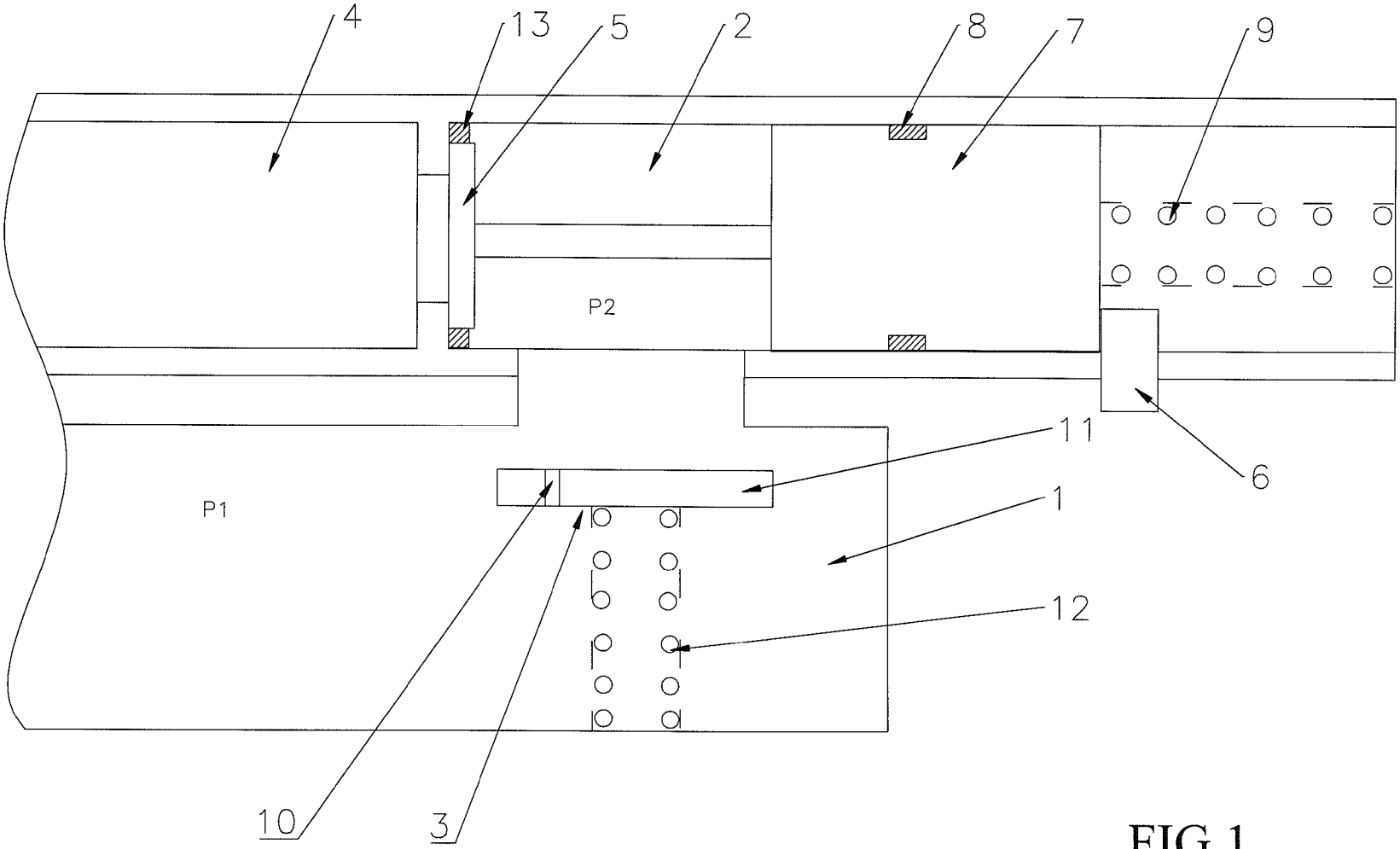
FIG. 1 is a schematic diagram of an embodiment of the invention in a static state.

The figures show a high pressure air storage chamber 1, a driving air chamber 2, an air stream automatic control valve 3, an air outlet 4, an air outlet valve 5, a trigger interlock mechanism 6, a piston 7, a piston sealing ring 8, a piston return spring 9, a bypass air stream hole 10, an air stream automatic control valve gate 11, an air stream automatic control valve return spring 12, an air outlet valve sealing ring 13, and an automatic projectile feeder 14.

The present invention is further described in detail with the aid of embodiments and accompanying figures.

Embodiment 1

As shown in FIG. 1, this embodiment describes a repeating mechanism for an air gun, comprising a high pressure air storage chamber 1 and a driving air chamber 2. An air stream automatic control valve 3 is arranged between the high pressure air storage chamber 1 and the driving air chamber 2, an air outlet valve 5 is arranged between the driving air chamber 2 and the air outlet 4, and the air outlet valve 5 is interlocked with a trigger interlock mechanism 6. Said air outlet valve 5 is interlocked with the trigger interlock mechanism 6. The air outlet valve 5 is connected with a piston 7, whose one end is located inside the driving air chamber 2 and the other end reaches out of the driving air chamber 2 via a piston sealing ring 8 and is then interlocked with the trigger interlock mechanism 6. In order to ensure that the piston 7 can effectively open the air outlet valve 5, the diameter of the piston 7 shall be greater than that of the air outlet valve 5 gate, making the piston 7 undertake a stress larger than the one undertaken by the air outlet valve 5. The piston 7 is arranged with a piston return spring 9, and an bypass air stream hole 10 is arranged between the high pressure air storage chamber 1 and the driving air chamber 2. In order to maintain the air stream automatic control valve 3 always open in a static state, an air stream automatic control valve return spring 12 can be arranged on an air stream automatic control valve gate 11. In a static state, the air stream automatic control valve return spring 12 pushes or pulls the air stream automatic control valve gate 11 open to enable it to be in a normally open state. The air stream automatic control valve 3 can be a shut-off valve or any other type of valve, which can achieve the same function according to the invention.

Figure 2:
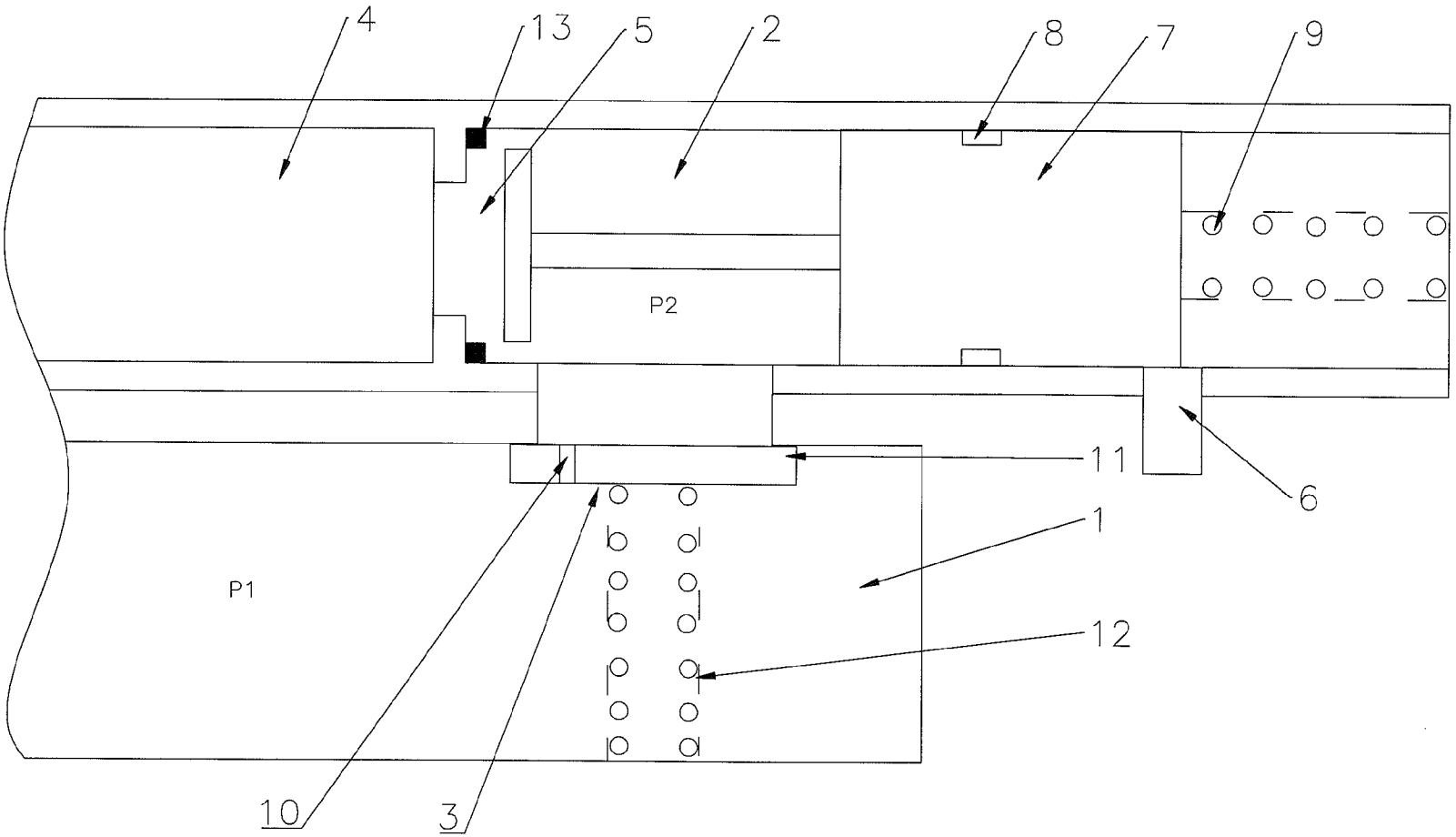
FIG. 2 is a schematic diagram of an airflow emission state.

When an air gun works, assume the air pressure of the high pressure air storage chamber 1 is P1 and the air pressure of the driving air chamber 2 is P2. As shown in FIG. 1, since the air stream automatic control valve 3 is normally open in a static state, then P1=P2. When the trigger interlock mechanism 6 is triggered, the piston 7 will be released and pushed backwards under the effect of P2. The air outlet valve 5 is opened to release the driving air of P2 from the driving air chamber 2. With the decline of P2, when the force of the P1 on the air stream automatic control valve 3 is greater than the force of the P2+ air stream automatic control valve return spring, the air stream automatic control valve 3 will be automatically closed. As shown in FIG. 2, the pressure of P2 will instantaneously reduce, and the piston 7, under the force of the piston return spring 9, will drive the air outlet valve 5 to close. The pressure of P2 will rise under the effect of the bypass air stream hole 10, and the air stream automatic control valve 3 will reopen to achieve a new balance under the effect of the air stream automatic control valve return spring 12. As long as the trigger interlock mechanism 6 is continuously pulled, the air outlet valve 5 and the air stream automatic control valve 3 will open or close repeatedly, so that continuous shooting is achieved.

During the above described action, at an early stage when the air outlet valve 5 opens, the projectile moves at a slower pace, and so does the airflow through the air outlet 4. P2 is able to meet air capacity to drive the projectile under the supplement of P1. The decrease in P2 is not remarkable, and the force of P1 on the air stream automatic control valve 3 is lower than that of P2+ the air stream automatic control valve return spring 12. With the projectile velocity increases, the airflow of the air outlet 4 increases accordingly. As the supplementation of P1 to P2 cannot meet the air capacity required by the projectile, the P2 will decrease. When the force of P1 on the air stream automatic control valve 3 is greater than that of P2+ the air stream automatic control valve return spring 12, the air stream automatic control valve 3 will be closed.

Figure 3:
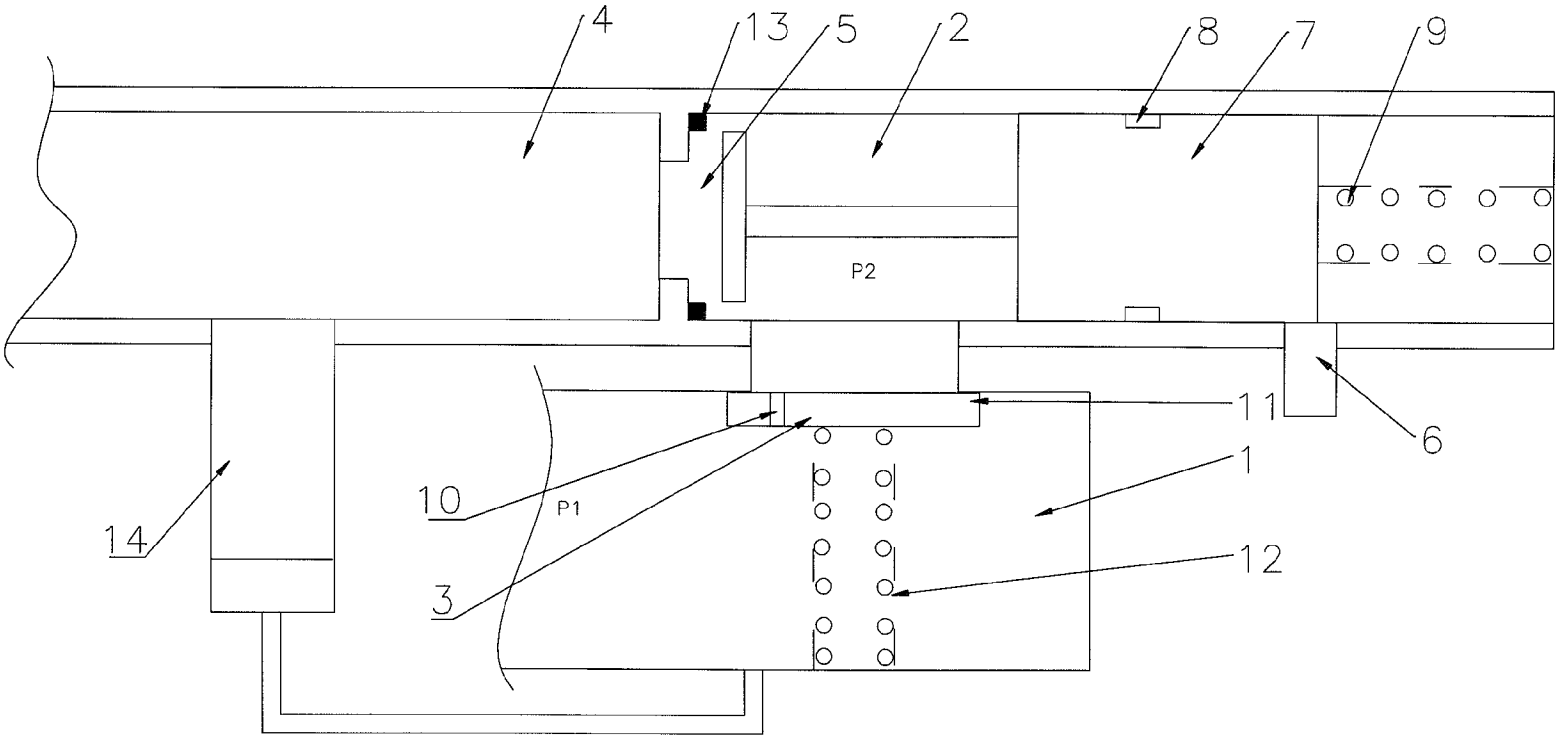
FIG. 3 is a schematic diagram of an automatic projectile feeder connecting with an air passage of the high pressure air storage chamber.

As shown in FIG. 3, the automatic projectile feeder 14 is connected with an air passage of the high pressure air storage chamber 1 and also controlled by the air pressure of the high pressure air storage chamber 1 to achieve synchronization between the continuous projectile feeding action and the air release time of the driving air chamber 2.

Figure 4:
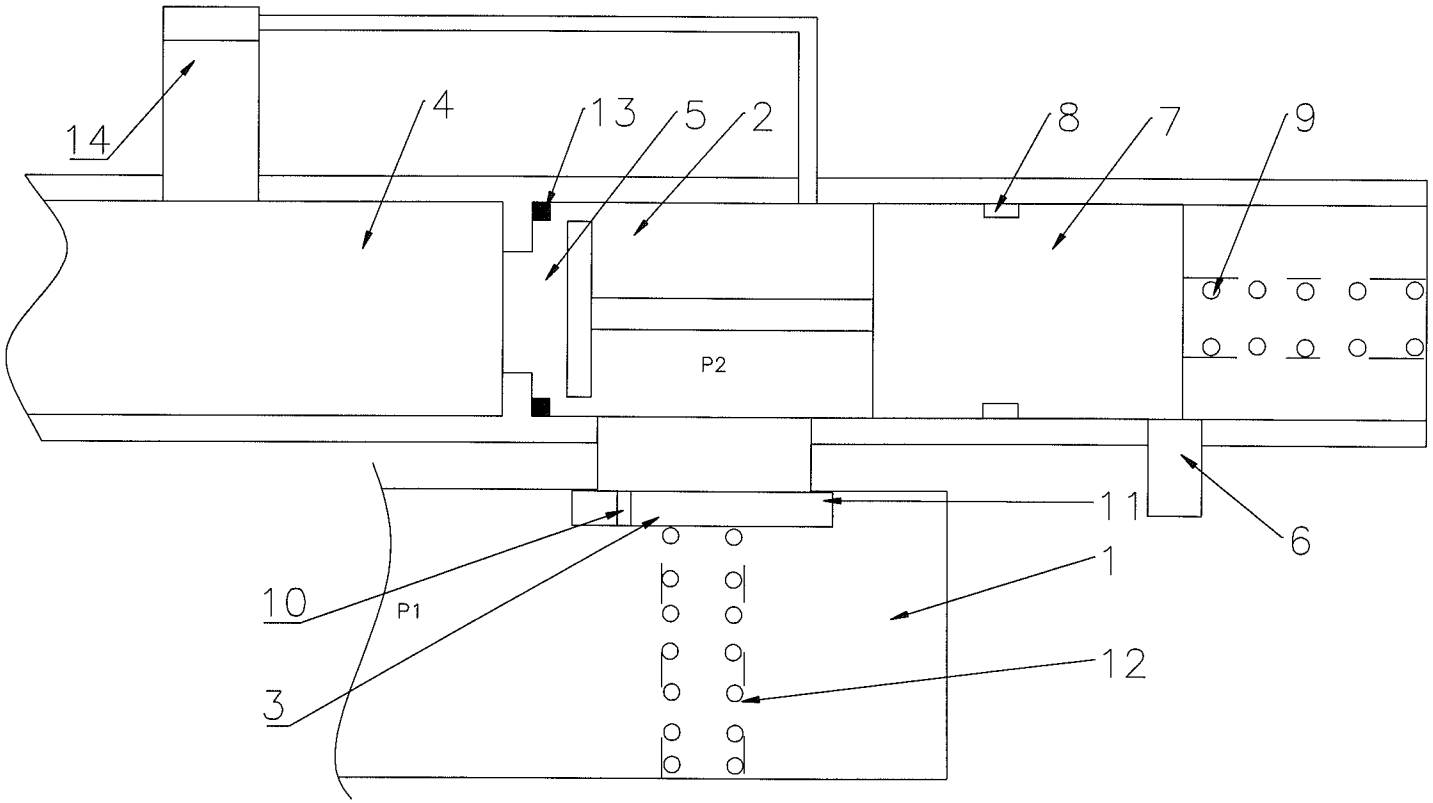
FIG. 4 is a schematic diagram of an automatic projectile feeder connecting with an air passage of the driving air chamber.

As shown in FIG. 4, the automatic projectile feeder 14 is connected with an air passage of the driving air chamber 2.

Figure 5:
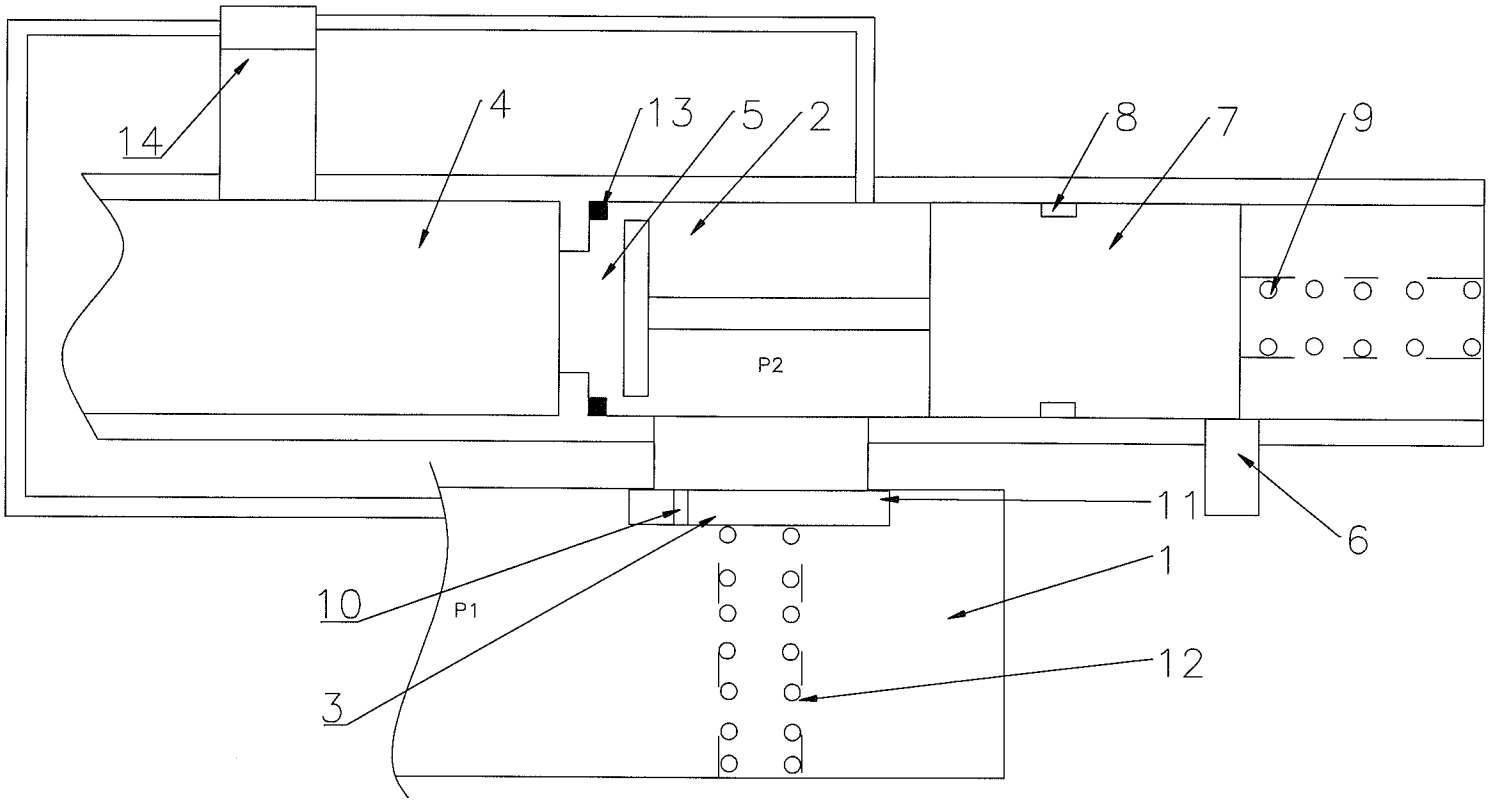
FIG. 5 is a schematic diagram of an automatic projectile feeder connecting with an air passage of both the high pressure air storage chamber and the driving air chamber.

As shown in FIG. 5, the automatic projectile feeder 14 is connected with an air passage of the high pressure air storage chamber 1 and the driving air chamber 2. Continuous projectile feeding action of the automatic projectile feeder 14 is controlled by a varied pressure difference of the high pressure air storage chamber 1 and the driving air chamber 2.

What is claimed is:

1. A repeating mechanism for an air gun comprising:

a high pressure air storage chamber;

a driving air chamber having an air outlet;

an air outlet, wherein the driving air chamber is located outside and connected to the high pressure air storage chamber;

an air stream automatic control valve arranged between the high pressure air storage chamber and the driving air chamber;

an air outlet valve arranged between the driving air chamber and the air outlet and between the air stream automatic control valve and the air outlet; and a trigger interlock mechanism, wherein said air outlet valve is interlocked with the trigger interlock mechanism, wherein the air outlet valve is connected with a piston reciprocal in the driving air chamber and having one end located inside the driving air chamber and another end reaching out of the driving air chamber via a piston sealing ring, with the air outlet valve biased to close the air outlet, with the piston moveable in the driving air chamber by high pressure air in the driving air chamber, and wherein the piston is interlocked with the trigger interlock mechanism, with the trigger interlock mechanism having a first condition and a second condition, with the piston and the air outlet valve being free to move in the driving air chamber in the first condition and with the piston and an outlet valve locked in the driving air chamber with the air outlet valve blocking the air outlet in the second condition.

2. The repeating mechanism for an air gun according to claim 1, wherein the diameter of the piston is greater than that of a gate of the air outlet valve located in the driving air chamber and abutting with the air outlet.

3. The repeating mechanism for an air gun according to claim 2, wherein the piston is arranged with a piston return spring to bias the air outlet valve to close the air outlet.

4. The repeating mechanism for an air gun according to claim 1, further comprising a bypass air stream hole arranged between the high pressure air storage chamber and the driving air chamber.

5. The repeating mechanism for an air gun according to claim 1, wherein said air stream automatic control valve is normally open in a static state.

6. The repeating mechanism for an air gun according to claim 4, wherein said air stream automatic control valve is normally open in a static state.

7. The repeating mechanism for an air gun according to claim 1, wherein said air stream automatic control valve is normally open in a static state, with the air stream automatic control valve comprising an air stream automatic control valve return spring and an air stream automatic control valve gate, with the air stream automatic control valve return spring arranged on the air stream automatic control valve gate and pushing or pulling the air stream automatic control valve gate open in the static state to enable the air stream automatic control valve to be in the normally open state.

8. The repeating mechanism for an air gun according to claim 4, wherein said air stream automatic control valve is normally open in a static state, with the air stream automatic control valve comprising an air stream automatic control valve return spring and an air stream automatic control valve gate, with the air stream automatic control valve return spring arranged on the air stream automatic control valve gate and pushing or pulling the air stream automatic control valve gate open in the static state to enable the air stream automatic control valve to be in the normally open state.

9. The repeating mechanism for an air gun according to claim 1, further comprising an automatic projectile feeder connected with an air passage of either the high pressure air storage chamber or the driving air chamber or both and controlled by air pressures of related high pressure air storage and driving air chambers.

10. The repeating mechanism for an air gun according to claim 1, further comprising a bypass air stream hole arranged between the high pressure air storage chamber and the driving air chamber.

11. The repeating mechanism for an air gun according to claim 2, further comprising a bypass air stream hole arranged between the high pressure air storage chamber and the driving air chamber.

12. The repeating mechanism for an air gun according to claim 3, further comprising a bypass air stream hole arranged between the high pressure air storage chamber and the driving air chamber.

13. The repeating mechanism for an air gun according to claim 1, wherein said air stream automatic control valve is normally open in a static state.

14. The repeating mechanism for an air gun according to claim 2, wherein said air stream automatic control valve is normally open in a static state.

15. The repeating mechanism for an air gun according to claim 3, wherein said air stream automatic control valve is normally open in a static state.

16. The repeating mechanism for an air gun according to claim 1, wherein the trigger interlock mechanism interlocks the piston and the air outlet valve closing the air outlet.

* * * * *